US007134975B1

(12) United States Patent
Van Asselt

(10) Patent No.: US 7,134,975 B1
(45) **Date of Patent: *Nov. 14, 2006**

(54) BALL GAME APPARATUS

(76) Inventor: Jan Abraham Van Asselt, 10 Stangrave Hall, Bletchingley Road, Godstone, Surrey RH9 8NB (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/980,092

(22) PCT Filed: May 25, 2000

(86) PCT No.: PCT/GB00/02008

§ 371 (c)(1),
(2), (4) Date: Feb. 11, 2002

(87) PCT Pub. No.: WO00/74801

PCT Pub. Date: Dec. 14, 2000

(30) Foreign Application Priority Data

Jun. 2, 1999 (GB) ..... 9912763.1

(51) Int. Cl.
*A63B 69/00* (2006.01)

(52) U.S. Cl. ..... 473/428; 473/426

(58) Field of Classification Search ..... 473/139–143, 473/147, 148, 149, 417, 423–431, 434, 439, 473/576, 453; 273/317.8, 331, 333–335
See application file for complete search history.

(56) References Cited

U.S. PATENT DOCUMENTS

| | | | | |
|---|---|---|---|---|
| 2,680,022 | A * | 6/1954 | Walden | 473/428 |
| 3,352,560 | A * | 11/1967 | Potter | 473/147 |
| 3,460,391 | A | 8/1969 | Lomas | 73/379 |
| 3,550,937 | A * | 12/1970 | Wright | 473/428 |
| 3,630,521 | A | 12/1971 | Lingbeek et al. | |
| 3,754,761 | A | 8/1973 | Pruss | |
| 4,067,569 | A * | 1/1978 | Palumbo | 482/48 |
| 4,138,107 | A | 2/1979 | Janis | |
| 4,944,513 | A | 7/1990 | Zentner | |
| 5,027,958 | A * | 7/1991 | Agardi | 211/119.1 |
| 5,413,347 | A * | 5/1995 | Prater | 473/147 |
| 5,465,958 | A * | 11/1995 | Brun | 473/426 |
| 5,762,562 | A | 6/1998 | Tiedge | 473/143 |
| 6,042,491 | A * | 3/2000 | Dixon, Jr. | 473/423 |

FOREIGN PATENT DOCUMENTS

| | | |
|---|---|---|
| GB | 115588 | 5/1918 |
| GB | 169578 | 10/1921 |
| GB | 201645 | 8/1923 |
| WO | 99/34884 | 7/1999 |

* cited by examiner

*Primary Examiner*—Eugene Kim
*Assistant Examiner*—Alvin A. Hunter, Jr.
(74) *Attorney, Agent, or Firm*—Blank Rome LLP

(57) ABSTRACT

Apparatus for practicing the techinque of lofting a ball, the apparatus having a support frame containing two upright supports linked by a horizontal cross-bar. Two inclined guideways extend between ground anchors and the supports. A substantially inelastic reciprocating device is connected to and freely movable along the guideways and a ball connected to the reciprocating device.

14 Claims, 1 Drawing Sheet

BALL GAME APPARATUS

Figure 1:
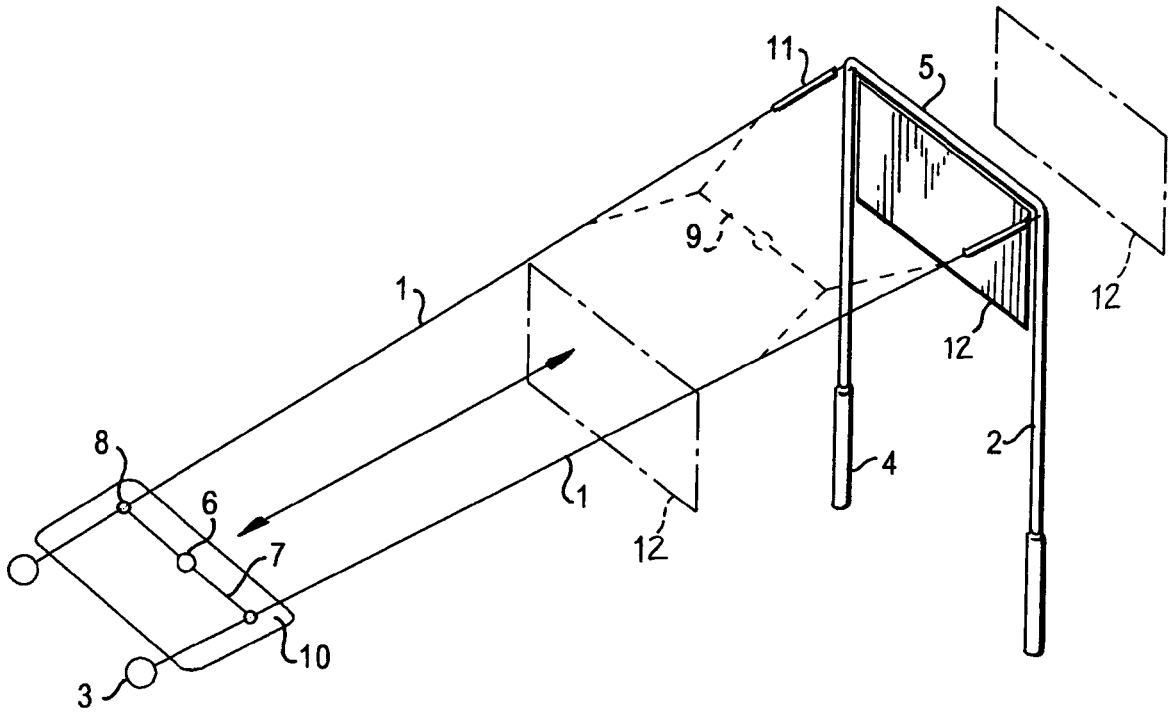

This invention relates to apparatus for use in practising the sport of golf or cricket and/or any other ball game which involves lofting a ball or like projectile (hereinafter referred to as a "ball") forwardly into the air. More especially, but not exclusively, the invention relates to apparatus for improving the skills of participants in such sports.

In the field of competitive sport it is a well known adage that practice makes perfect. Thus, for example, golf players spend many hours improving, inter alia, their golf swing.

In other ball game sports there are several inanimate trainers available, these including, inter alia, a ball attached by an elasticated strand, string or rope to some form of central support. Such trainers are unsatisfactory because the ball approaches the player at an unrealistic angle and speed. Furthermore, missing the ball results in the elasticated strand, string or rope becoming inconveniently entangled around the support.

Children also enjoy ball games, but unless they are coached, they have even less opportunity of improving their skills. Furthermore, few children have sufficient space and freedom from houses and cars to play ball games unrestrictedly.

U.S. Pat. No. 4,138,107 relates to a ball game practice device which comprises a ball connected to an elastic tether, the tether connected at either end to a carriage member which runs along a rigid rail. It is the elastic nature of the tether which after full stretch, returns the ball to the player.

U.S. Pat. No. 3,630,521 relates to a baseball batting practice device. Once again, a ball is connected to an elastic cord which is slidably linked to an upper and lower support wire. In both these disclosures, the elastic nature of the tether to the ball allows somewhat uncontrolled lateral movement of the ball once struck by the player.

Thus, there is a need to provide apparatus for simulating a golf or cricket swing or the like, to be used in a controlled manner in relatively small areas without concern over surrounding buildings and cars.

The present invention sets out to provide such apparatus.

Accordingly, in one aspect the invention provides apparatus for improving the skill of a sports person which comprises two upwardly inclined side by side diverging guideways, a substantially inelastic reciprocating line connected to and freely movable along said guideways, whose length is equal to or greater than the minimum spacing of the guideways and less than the maximum spacing of the guideways and a ball connected to said reciprocating line, the apparatus being characterised in that the ball is generally coaxial with the reciprocating line.

The term "substantially inelastic" as used herein applies to materials which have a very limited ability to stretch and change length when struck.

One end of each of the two guideways is typically secured or securable at substantially ground level, for example, to the ground via an anchor comprising, for example a stake or ground pin, or to a stable support. The other end of each of the two guideways is typically attached to a stable support. In particular, the stable support may be a wall, frame or a pole.

The length of the guideways and/or their angle of inclination above ground level may be varied in order to vary the type and/or difficulty of swing or stroke required. For example, if a user would like to simulate a drive swing, the guideways may be kept long and their angle of inclination low. For practising more lofted shots, the angle of inclination of the guideways may be increased.

Preferably, the supports are linked, for example by a rigid support bar, thereby ensuring that the guideways are maintained at a predetermined distance apart.

In this arrangement, when the reciprocating means is positioned at, or towards, the lower end of the guideways, a player may strike the ball and propel the reciprocating means forwardly and upwardly along the guideways. However, when the length of the reciprocating means becomes limiting in relation to the distance separating the two guideways, the reciprocating means decelerates, stops and is deflected back along the guideways towards the player.

Importantly, the reciprocating means is made from a substantially inelastic material. Not only does this ensure that the ball maintains a controlled trajectory regardless of the angle at which the player hits the ball, but the relative inelasticity of the reciprocating means ensures its length becomes limiting in relation to the distance between the two guideways thereby deflecting the ball back to the player.

The invention also contemplates an embodiment wherein the reciprocating means comprises more than one substantially inelastic substantially horizontal line, for example, wherein the reciprocating means comprises one substantially inelastic substantially horizontal line connected to one guideway and another associated substantially inelastic substantially horizontal line connected to the other guideway.

The reciprocating means may be connected or connectable to the guideways through a slide which may comprise a hinged clip, ring, rope slide or adjustable loop.

In one embodiment one or both guideways and/or the reciprocating means are made of a low friction material such as plastics covered cord or wire. The guideways and the reciprocating means may be made of the same material.

Tensioning means may be provided for varying the tension of each guideway. This may comprise a reel connected to the respective anchor or support.

The invention also contemplates an embodiment wherein one or both guideways are made of a substantially rigid material. By substantially rigid it is meant relatively inflexible. Therefore, one or both guideways may take the form of a plastics track which is capable of receiving a runner to which the reciprocating means is connected.

The ball may be connected at any point along the reciprocating means.

The ball may be, for example, a cricket ball or a golf ball, or a simulated cricket or golf ball.

The guideways may be kept within retaining means when not in use. For example, the retaining means may take the form of a coil or spool around which the guideways may be wound. The retaining means may comprise an automatic reeling mechanism for the guideways. In such an embodiment, the user would unwind a length of each guideway, and secure each guideway by one end to a base, e.g. to the ground, to ensure that the automatic reeling mechanism does not rewind the guideways.

In one embodiment, the supports and/or the guideways and/or the retaining means may be attached or attachable to each other.

The retaining means may comprise an automatic reeling mechanism for the guideway.

The height and positioning of the lower ends of the guideways may be adjustable.

The guideways lie in a plane which is generally inclined thereto. One or each guideway may take the form of a string, rope or the like stretchable between two spaced supports. The line may be coated with or formed from a material having relatively low friction properties, for example a plastics material.

The substantially inelastic substantially horizontal line(s) may be connected to one and/or both guideways by a slide in the form of, for example, a loop or ring.

The apparatus may also comprise a backboard or target at which the user of the apparatus may aim when hitting the ball. The target may be placed at any position remote from of the lower end of the guideways.

The apparatus may also comprise a buffer or deflector at any position along the guideways to return the reciprocating means back to the user after the ball is struck. The backboard or target acts as a buffer or deflector.

The invention will now be described by way of example only with reference to the drawing in which the sole FIG. 1 is a perspective of one embodiment of the apparatus in accordance with the invention.

The apparatus shown in the drawing takes the form of a golf training aid, especially for one player. The apparatus comprises two guideways 1, of plastics coated cord which are attached at their ends to supports 2 and anchorages 3, typically spaced approximately 10–12 meters apart. Typically, the heights of the supports 2 above ground level are two meters. The supports 2 are held in position by ground engaging metal supports 4. The height of each support is adjustable. A rigid support pole 5 maintains the tops of the supports 2 at a predetermined distance apart. The support pole 5 may be positioned at a lower height relative to the supports 2 if required. The guideways are fixed at ground level by anchorages in the form of ground pegs 3. A ball 6 is suspended by a substantially inelastic line 7 from the guideways. Each end of the line 7 is linked to the guideways by a loop or ring 8. The line 7 may be secured to the ball by stitching, stapling or any other means. In an alternative arrangement, two inelastic lines are used, one linking one side of the ball to one guideway, the other linking the other side of the ball to the other guideway.

When the training aid is in use, a player stands near the lowermost end of the guideways 1 at their point of connection to the ground pegs 3 and strikes the ball 6 with a golf club. The starting positions of the ball 6 and line 7 are shown in full line in the drawing. The force of the strike sends the line 7 and the ball 6 along the guideways 1 towards the limiting postion shown in broken line 9. Once the distance between the ends of the line 7 becomes limiting in relation to the distance between the guideways, the line 7 slows down, stops and is deflected back along the guideways under gravity to return to the player who can then strike the ball again.

Winding and retaining means 11 may be included on either or both guideways to store the guideways 1 when not in use.

Whilst the apparatus is in use, the player may stand on a teeing-off mat 10 which may be made of any suitable material. Hence, the apparatus may be used on any surface, for example, grass, sand or concrete, and the user can still simulate conditions of play.

It will be appreciated that the foregoing is merely exemplary of embodiments of the invention and that modifications can readily be made without departing from the scope of the invention as set out in the appended claims. Thus, the supports 2 may be replaced by a frame comprising a pair of interconnected tripods to which the upper end of the guideways are secured. A target or rebound board 12 may be supported between the tripods in the path of trajectory of the ball.

The invention claimed is:

1. Apparatus for improving the skill of a sports person comprising:

a first guideway and a second guideway wherein each of said first and second guideways are inclining upwardly and positioned side-by-side and said first and second guideways having a first end and a second end configured such that said first ends of said guideways having a minimum spacing therebetween and said second ends of said guideways having a maximum spacing therebetween, a substantially inelastic reciprocating line having a first end and a second end wherein said first and second ends of the reciprocating line are connected to said first and second guideways respectively to allow free movement along said guideways, said reciprocating line having a length equal to or greater than the minimum spacing and less than the maximum spacing, and a ball connected to the reciprocating line wherein the ball is coaxial with said reciprocating line.

2. Apparatus as claimed in claim 1, wherein a first end of each of the two guideways is secured or securable at ground level by an anchorage.

3. Apparatus as claimed in claim 2, wherein the tensioning means comprises a reeling mechanism.

4. Apparatus as claimed in claim 2, wherein the anchorage comprises a stake or ground pin.

5. Apparatus as claimed in claim 4, wherein a second end of each of the two guideways is attached to a stable support.

6. Apparatus as claimed in claim 1, wherein means are provided for varying the length of the guideways and/or their angle of inclination above ground level.

7. Apparatus as claimed in claim 1, wherein the reciprocating line is connected or connectable to the guideways through a slide.

8. Apparatus as claimed in claim 7, wherein the slide comprises a hinged clip, ring, rope slide or adjustable loop.

9. Apparatus as claimed in claim 1, wherein at least one guideway and the reciprocating line are made of a low friction material.

10. Apparatus as claimed in claim 9, wherein the material comprises a plastic-covered cord or wire.

11. Apparatus as claimed in claim 1, wherein at least one guideway is made of a substantially rigid material.

12. Apparatus as claimed in claim 1, further comprising tensioning means for varying the tension of the at least one guideway.

13. Apparatus as claimed in claim 1, further comprising a backboard or target at which the ball may be aimed, wherein the backboard or target is positioned in the path of a trajectory of the ball.

14. Apparatus as claimed in claim 13, wherein the backboard or target is oriented substantially perpendicular to the longitudinal axis of the guideways and located between the diverging guideways at a point along the guideways between the first ends of each of the two guideways where they are secured or securable at ground level by an anchorage and the second ends of each of the two guideways where they are attached to a stable support.

* * * * *